US005215399A

United States Patent [19]

Berger

[11] Patent Number: 5,215,399

[45] Date of Patent: Jun. 1, 1993

[54] ROAD-TRAFFIC BARRICADE OR BARRIER WITH TIRE BASE

[76] Inventor: James Berger, Box 13, Big Rock, Ill. 60511

[21] Appl. No.: 892,967

[22] Filed: Jun. 3, 1992

[51] Int. Cl.[5] ..... E01F 13/00

[52] U.S. Cl. ..... 404/6

[58] Field of Search ..... 404/6–11

[56] References Cited

U.S. PATENT DOCUMENTS 3,621,807 11/1977 Kang ..... 404/9 X
4,050,401 9/1977 Kelly ..... 404/6 X
4,123,183 10/1978 Ryan ..... 404/10
5,165,818 11/1992 Newhart ..... 404/10

*Primary Examiner*—Thuy M. Bui
*Attorney, Agent, or Firm*—Milton S. Gerstein

[57] ABSTRACT

A barricade or barrier for road-warning signs, which utilizes just one vertical, mounting support-pole to which is mounted the road-hazard or road-warning sign, or the like. The single, vertical support-pole is mounted to a base made of a used tire by means of a pair of bracket-arms, with the two bracket-arms being vertically spaced apart and extending transversely to each other. The two bracket-arms are bolted to the used-tire base, with the upper bracket-arm being bolted to the upper, annular surface of the used tire, and with the lower bracket-arm being bolted to the bottom, annular surface of the tire-base, whereby the two bracket-arms sandwich the tire therebetween for a strong, stable mounting of the support-pole secured to the two bracket-arms. The support-pole is removably mounted to the mounting bracket-arms, and itself is modular in construction to allow for easy assembly and disassembly, and to ensure proper mounting of the two bracket-arms to the tire-base. The tire constituting the base is also provided with a series of drain-holes on its bottom surface and also on its annular rim, so that rain water may be drained out from the tire, regardless of the angular orientation of the barricade and its tire-base.

20 Claims, 2 Drawing Sheets 21
42
44
50
46
46'
46"
21

52
30
24
26
52
14
50

44
42'
42
10
21

40
21
40

21'
24
32
28
32'
20
20'
36
26
30
16
24
54
28
36
32
12
54
14
16'
20
18'
30
26
18

ROAD-TRAFFIC BARRICADE OR BARRIER WITH TIRE BASE

BACKGROUND OF THE INVENTION

The present invention is directed to a barricade or barrier for supporting warning signs for indicating a specific, upcoming road hazard. Conventional barricades or barriers are of the horse-type, are bulky to use and store, and are relatively expensive to produce. One prior-art modification of the horse-type barricade is shown in U.S. Pat. No. 4,312,600, which utilizes a used-tire support base. Secured to the tire-base are a pair of upstanding mounting support-poles for mounting horizontal banners, or panels, constituting the barricade proper. However, the securement of the mounting support-poles to the tire-base requires that a pair of such poles be used for mounting the barricade panels. Even with such mounting and with the use of two such poles, the structural integrity and strength of the overall device is less than desirable, and, also, makes the barricade relatively costly to make and cumbersome to use and store.

SUMMARY OF THE INVENTION

It is the primary objective of the present invention to provide a road-barricade or road-barrier utilizing a used-tire base, but which is much less costly to produce, more structurally sound, and easily disassembled for storage and transport.

Toward these and other ends, the barricade or barrier of the invention utilizes just one vertical, mounting support-pole to which is mounted a road-hazard or road-warning sign, or the like. The single, vertical support-pole is mounted to a tire-base by means of a pair of bracket-arms, with the two bracket-arms being vertically spaced apart and extending transversely to each other. The two bracket-arms are bolted to the used-tire base, with the upper bracket-arm being bolted to the upper, annular surface of the used tire, and with the lower bracket-arm being bolted to the bottom, annular surface of the tire-base, whereby the two bracket-arms sandwich the tire therebetween for a strong, stable mounting of the support-pole secured to the two bracket-arms. The support-pole is removably mounted to the mounting bracket-arms, and itself is modular in construction to allow for easy assembly and disassembly, and to ensure proper mounting of the two bracket-arms to the tire-base. The tire constituting the base is also provided with a series of drain-holes on its bottom surface and also on its annular rim, so that rain water may be drained out from the tire, regardless of the angular orientation of the barricade and its tire-base.

BRIEF DESCRIPTION OF THE DRAWING

The invention will be more readily understood with reference to the accompanying drawing, wherein.

DETAILED DESCRIPTION OF THE INVENTION

Figures 1, 2, 3, 4, 5:
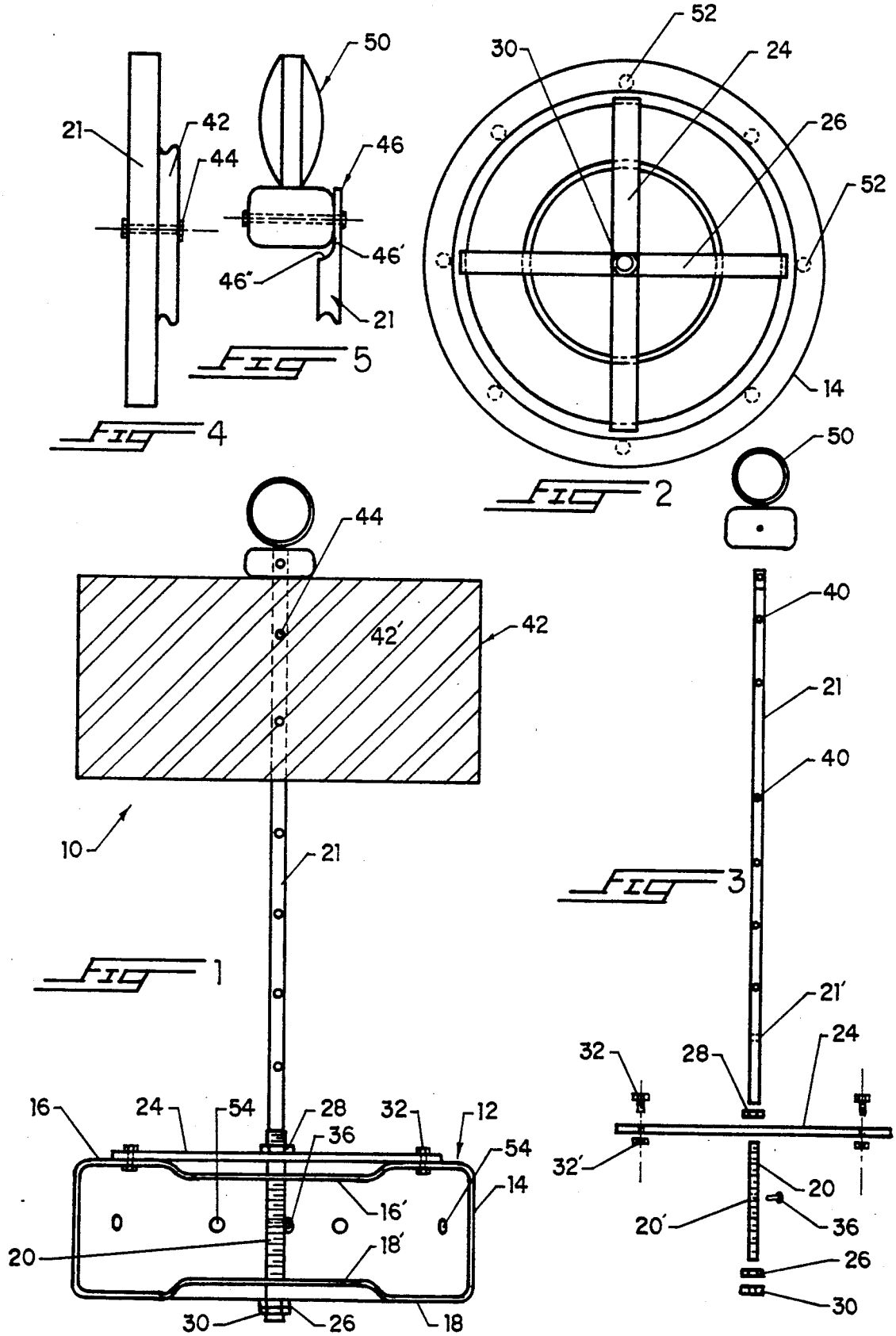
FIG. 1 is a front, elevational view of the road-barrier or barricade according to the invention.
FIG. 2 is a bottom view thereof.
FIG. 3 is a side, assembly view showing the arrangement of the removably-connected parts thereof.
FIG. 4 is a detail view, in side elevation, showing the connection between the upright support-pole of the barricade and a warning sign.
FIG. 5 is a detail view, in side elevation, showing the removable mounting of a warning light to the top of the support-pole of the barricade of FIG. 1.

Referring now to the drawings in greater detail, the traffic-warning barricade or barrier is indicated generally by reference numeral 10. The barrier 10 has a base 12 made of a used, vehicle tire, either that from an automobile or truck, depending upon the particular size one desires the barrier to be, and the particular size of signs intended to be supported thereby. The tire-base 12 defines an annular side-surface, or wall, 14, a top, or upper, annular surface, or wall, 16, and a bottom, annular surface, or wall, 18, with the interior of the tire, of course, being hollow. Positioned within the hollow interior of the tire-base is a threaded, hollow shaft 20, which shaft 20 preferably has an overall length greater than the height of the tire as measured between the top and bottom surfaces 16 and 18, as best seen in FIG. 1. The shaft 20 is used for removably mounting a support-pole 21, which shaft is mounted to the tire-base by means of a pair of horizontal, vertically-spaced-apart bracket-arms 24, 26, with the upper bracket-arm 24 extending transversely of the extension of the lower bracket-arm 26. Each bracket-arm 24, 26 has a central opening through which extends the upper and lower ends, respectively, of the threaded shaft 20. Nuts 28, 30 secure the bracket-arms on the shaft. By rotating the nuts 28, 30, the two bracket-arms 24, 26 are forced toward each other to tightly sandwich therebetween the tire-base, with the upper bracket-arm 24 abutting against the top, annular surface 16 and the lower bracket-arm abutting against the bottom, annular surface 18. To ensure even greater securement and greater structural integrity, the ends of the two bracket-arms may be fastened to the respective top and bottom surfaces by means of bolts 32. The ends of the bracket-arms have holes for passing these bolts, and the top and bottom surfaces are also provided with through-holes for passing therethrough the shanks of the bolts. Nuts 32' secure the bolts in place. The length of each bracket-arm is preferably long enough so as to ensure securement to the respective top and bottom annular surface 16, 18, so that each bracket-arm spans the distance across the thinner, annular flap section 16', 18' of a conventional tire. Having the bracket-arms extend transversely to each other provides greater structural support, since the torques created by the movement of the support-pole 21 is any direction will be compensated and taken up by different sections of the tire-base, with forces from movement in any direction being transmitted to at least one section of the tire-base walls. Thus, for movements of the support-pole 21 into the plane of the drawing, for example, the bracket-arm 26 and the entire bottom-wall of the tire-base will absorb and take up the forces and torques associates therewith, while for movements of the support-pole 21 in the plane of the drawing, for example, being taken up by the upper bracket-arm 24 and the entire top wall of the tire-base.

The pole 21 is preferably a circular, hollow tube having an outer diameter less than the inner diameter of the hollow shaft 20, so that the lower portion of the pole 21 may be telescopingly received in the hollow shaft. The shaft 20 has a central hole 20' for passing therethrough a cotter pin 36, which cotter pin also passes through a hole 21' formed in the lower portion of the support-pole, by which the support-pole may be removably mounted to the shaft 20. The support-pole 21 is provided with a series of vertically-spaced-apart holes 40 for mounting a conventional warning sign 42. Bolts 44 mounts the sign 42 by passing through holes in the sign and through the holes 40, as clearly seen in FIG. 1. The upper end 46 of the support-pole 21 turns into a thinner section 46' after a transition section 46''. This thinner section 46' constitutes the uppermost part of the support-pole, to which is secured a conventional flashing warning light 50, as best seen in FIG. 5. The thinner section 46' provides that the flashing light 50 does not protrude appreciably out from the support-pole and beyond the vertical plane of the front surface 42' of the warning sign 42.

The tire-base 12 is also provided with a series of equally-spaced-apart holes 52 in the bottom surface 18, which holes 52 serve as drainage holes, so that rain water does not accumulate in the interior of the tire-base. The annular side-surface 14 is also preferably provided with equally-spaced-apart drain holes 54, which drain-holes 54 are functional for draining water out when the tire-base 12 is not in use and stored on a horizontal hook, or the like, with the annular side-surface 14 being vertically oriented.

For disassembling the unit, after having removed the bolts 32, one first removes the lower nut to take off the lower bracket-arm 26, and then pulls up the rest of unit through the hollow interior and out through the upper central opening formed by the top surface of the tire. Thereafter, the upper bracket-arm 24 is removed from the threaded shaft, and then the support-pole 21 is removed by releasing the cotter pin. The separated parts are, therefore, more easily stored and transported.

Figure 6:
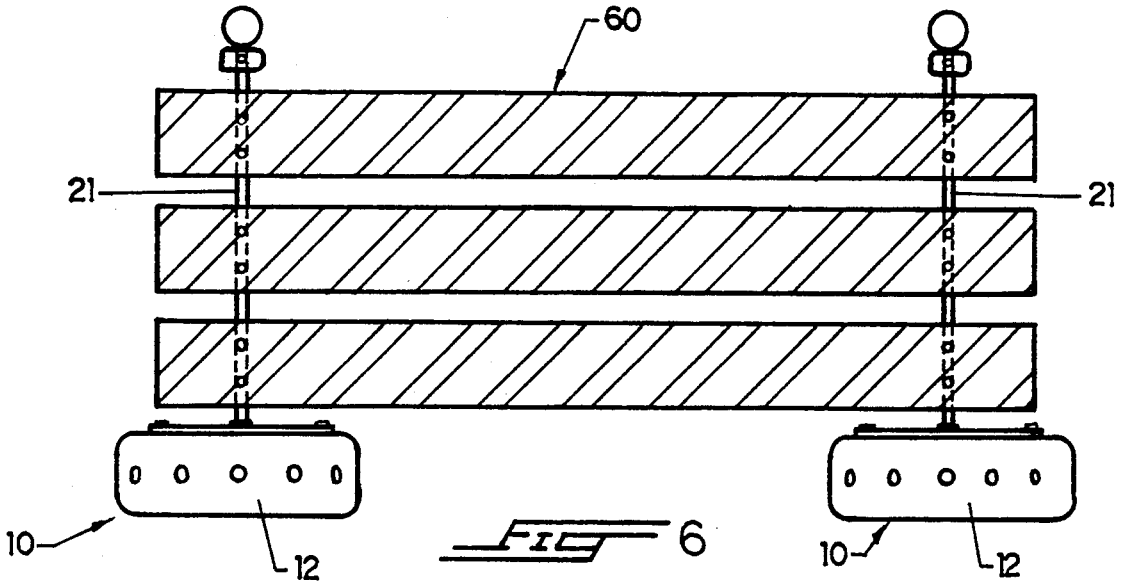
FIG. 6 is a front view of a modification of the barricade of the invention in which two like-barricades of FIG. 1 are used to jointly support a relatively-large warning indicator.

FIG. 6 shows a modification in which two barricades 10, with their tire-bases 12 and associated, above-described structure, are used with for supporting an oversized, or long, warning sign or barricade panels 60. The panels 60 are secured at each end to one support-pole 21, whereby greater strength and stability are provided.

Figure 7:
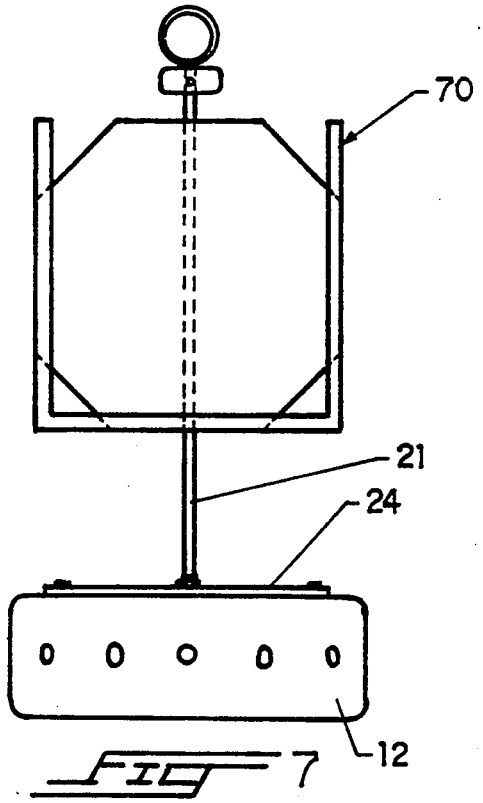
FIG. 7 is a front, elevational view showing the barricade of FIG. 1 supporting a conventional, road-sign storage-unit in which are stored different road-warning signs.

FIG. 7 shows the barricade 10 supporting a conventional sign-storage unit 70, in which are stored a plurality of different signs, so that one, chosen sign may be placed in the front for its display. The unit 70 is secured to the pole 21 by bolts, as described above for securing the warning sign 42.

The parts of the barricade of the invention are preferably made of recycled plastic, except, of course, for the tire-base. Small reflectors may be attached to the rim of the tire. Since the barricade of the invention has a very low center of gravity, because of its tire-base, it is not easily tipped over, and, if tilted, as, for example, by a car, will quickly vertically-right itself. Thus, for most applications, sand bags, that are conventionally used to prevent the tipping over of conventional barriers, are not needed. If sand bags are used, they may be placed within the hollow interior of the tire, where they are out of sight. If the barricade of the invention were to be run over by a truck, or the like, then, owing to its capability of being disassembled, it may be repaired in situ, with only the broken parts requiring replacement rather than the entire barricade, as is the case in the conventional-type of barricade. Of course, the barricade of the invention may be used in any situation where it is desirable to display a sign, and not just for traffic-control. Owing to its modular construction, it may be stored even in the trunk of a car.

While a specific embodiment of the invention has been shown and described, it is to be understood that numerous changes and modifications may be made therein without departing from the scope, spirit and intent of the invention as set forth in the appended claims.

What I claim is:

1. In a traffic-warning barrier comprising a base comprising a tire having a top surface, a bottom surface, an annular side surface, and a hollow interior, each of said bottom and top surfaces defining a central opening; and mounting means for mounting a warning indicator, said mounting means being mounted to said tire, the improvement comprising:

said mounting means comprising an upright support-pole means extending into and projecting upwardly from said central opening of said top surface of said tire, and securing means for securing said support-pole means to said tire.

2. The barrier according to claim wherein said securing means comprises a first, upper, horizontal bracket-arm and a second, lower, horizontal bracket-arm; each of said bracket arms having a centrally-located hole; said support-pole means comprising a threaded shaft-portion having an upper end and a lower end passing through said hole of said first bracket-arm and said hole of said second bracket-arm, respectively; and nuts for holding said bracket-arms on said shaft-portion; said upper bracket-arm abutting against said top surface of said tire, and said lower bracket-arm abutting against said bottom surface of said tire, whereby said bracket-arms sandwich said tire therebetween and are held thereagainst via said nuts of said threaded shaft-portion.

3. The barrier according to claim 2, wherein said support-pole means further comprises a main, warning-indicator pole-section to which may be mounted at least one warning-indicator, said pole-section and said threaded shaft-portion being separable elements removably coupled together.

4. The barrier according to claim 3, wherein said pole-section and said threaded shaft-portion are hollow tubular elements, said pole-section being partially telescopingly received in said shaft-portion, and means for removably securing said pole-section to said shaft-portion.

5. The barrier according to claim 4, wherein said means for removably securing said pole-section to said shaft-portion comprises a cotter pin, said shaft-portion and said pole-section having cooperating holes for receiving therethrough a portion of said cotter pin.

6. The barrier according to claim 4, wherein said pole-section comprises a series of holes, and bolts for cooperating with said holes for mounting a warning indicator to said support-pole means.

7. The barrier according to claim 1, wherein at least one of said bottom surface and said annular side-surface comprises a plurality of drain-holes for draining water from the interior of said tire.

8. The barrier according to claim 2, wherein each of said upper. and lower bracket-arms comprises a first end-portion and a second end-portion, and a hole formed in each said end-portion; said securing means further comprising fastening means passing through said holes for securing said end-portions to the respective said bottom surface and said top surface; each of said top and bottom surfaces of said tire having cooperating holes for passing said fastening means therethrough.

9. The barrier according to claim 8, wherein at least one of said bottom surface and said annular side-surface comprises a plurality of drain-holes for draining water from the interior of said tire.

10. The barrier according to claim 2, wherein said upper bracket-arm and said lower bracket-arm extend substantially transversely to each other.

11. The barrier according to claim 10, wherein said pole-section comprises an upper, thinner end for mounting thereto a flashing, warning light.

12. The barrier according to claim 10, further comprising a warning indicator mounted to said support-pole means, and a flashing warning light unit mounted to said upper thinner end.

13. The barrier according to claim 1, comprising a pair of said barriers, and a relatively-long, warning indicator-means having a first end-portion and a second end-portion, said pair of barriers mounting said warning indicator means at said first and second end-portions, one said barrier for one said end.

14. A traffic-warning barrier comprising, a base comprising a tire having a top surface, a bottom surface, an annular side-surface, and a hollow interior, each of said bottom and top surfaces defining a central opening; and mounting means for mounting a warning indicator, said mounting means being mounted to said tire:

said mounting means comprising an upright, support-pole means extending into and projecting upwardly from said central opening of said top surface of said tire, and securing means for securing said support-pole means to said tire.

15. The barrier according to claim 14, wherein said securing means comprises a first, upper, horizontal bracket-arm and a second, lower, horizontal bracket-arm; each of said bracket arms having a centrally-located hole; said support-pole means comprising a threaded shaft-portion having an upper end and a lower end passing through said hole of said first bracket-arm and said hole of said second bracket-arm, respectively; and nuts for holding said bracket-arms on said shaft-portion; said upper bracket-arm abutting against said top surface of said tire, and said lower bracket-arm abutting against said bottom surface of said tire, whereby said bracket-arms sandwich said tire therebetween and are held thereagainst via said nuts of said threaded shafted-portion.

16. The barrier according to claim 15, wherein said support-pole means further comprises a main, warning-indicator pole-section to which may be mounted at least one warning-indicator, said pole-section and said threaded shaft-portion being separable elements removably coupled together, said pole-section and said threaded shaft-portion being hollow tubular elements, said pole-section being partially telescopingly-received in said shaft-portion, and means for removably securing said pole-section to said shaft-portion.

17. The barrier according to claim 14, wherein at least one of said bottom surface and said annular side surface comprises a plurality of drain-holes for draining water form the interior of said tire.

18. The barrier according to claim 15, wherein each of said upper and lower bracket-arms comprises a first end-portion and a second end-portion, and a hole formed in each said end-portion; said securing means further comprising fastening means passing through said holes for securing said end-portions to the respective said bottom surface and top surface; each of said top and bottom surfaces of said tire having cooperating holes for passing said fastening therethrough.

19. The barrier according to claim 15, wherein said upper bracket-arm and said lower bracket-arm extend substantially transversely to each other.

20. A method of using a barrier, said barrier comprising a base comprising a tire having a top surface, a bottom surface, an annular side surface, and a hollow interior, said bottom and top surfaces defining a central opening; and mounting means for mounting a warning indicator, said mounting means being mounted to said tire, said mounting means comprising an upright support-pole means extending into and projecting upwardly from said central opening of said top surface of said tire, and securing means for securing said support-pole means to said tire, said securing means comprising a first, upper, horizontal bracket-arm and a second, lower, horizontal bracket-arm; each of said bracket arms having a centrally-located hole; said support-pole means comprising a threaded shaft-portion having an upper end and a lower end passing through said hole of said first bracket-arm and said hole of said second bracket-arm, respectively; and nuts for holding said bracket-arms on said shaft-portion; said upper bracket-arm abutting against said top surface of said tire, and said lower bracket-arm abutting against said bottom surface of said tire, whereby said bracket-arms sandwich said tire therebetween and are held thereagainst via said nuts of said threaded shafted-portion, said support-pole means further comprising a main, warning-indicator pole-section to which is mounted at least one warning-indicator, said pole-section and said threaded shaft-portion being separable elements removably coupled together, and means for removably securing said pole-section to said shaft-portion, said method comprising:

(a) disassembling said lower bracket-arm from said threaded shaft-portion;

(b) after said step (a), pulling said shaft-portion up through the hollow interior and through the upper central opening of the top surface;

(c) after said (b), disassembling said upper bracket-arm from said shaft-portion;

(d) disassembling said pole-section from said shaft portion by removing said means for removably securing; and (e) storing said parts in their separated states.

* * * * *